United States Patent [19]

Augustin

[11] Patent Number: 4,494,514

[45] Date of Patent: Jan. 22, 1985

[54] HYDRAULIC ADJUSTING DEVICE FOR CONTROLLING THE BEGINNING OF INJECTION OF AN INJECTION PUMP

[75] Inventor: Ulrich Augustin, Kernen, Fed. Rep. of Germany

[73] Assignee: Daimler-Benz Aktiengesellschaft, Stuttgart, Fed. Rep. of Germany

[21] Appl. No.: 468,999

[22] Filed: Feb. 23, 1983

[30] Foreign Application Priority Data

Feb. 23, 1982 [DE] Fed. Rep. of Germany ..... 3206429

[51] Int. Cl.[3] ..... F02M 59/30

[52] U.S. Cl. ..... 123/504; 123/502

[58] Field of Search ..... 123/502, 501, 500, 503, 123/504, 90.16

[56] References Cited

U.S. PATENT DOCUMENTS

| | | | |
|---|---|---|---|
| 2,863,438 | 12/1958 | Challis | 123/502 |
| 2,997,994 | 8/1961 | Falberg | 123/502 |
| 3,859,973 | 1/1975 | Dreisin | 123/502 |
| 4,223,648 | 9/1980 | Pozniak et al. | 123/90.16 |
| 4,249,499 | 2/1981 | Perr | 123/502 |
| 4,254,749 | 3/1981 | Krigg et al. | 123/502 |
| 4,281,792 | 8/1981 | Sisson et al. | 123/502 |
| 4,407,241 | 10/1983 | Butler et al. | 123/501 |

*Primary Examiner*—Magdalen Y. C. Moy

*Attorney, Agent, or Firm*—Barnes & Thornburg

[57] ABSTRACT

The invention relates to an hydraulic adjusting device for controlling the start of an injection pump for a self igniting internal combustion engine, wherein means are provided for changing the effective working stroke of the pumping shaft of the injection pump. A preferred arrangement includes a cup washer disposed in a hydraulic fluid control space intermediate a pump shaft driving tappet roller support and an inner piston slidably and elastically supported at the injection pump shaft.

10 Claims, 4 Drawing Figures

HYDRAULIC ADJUSTING DEVICE FOR CONTROLLING THE BEGINNING OF INJECTION OF AN INJECTION PUMP

BACKGROUND AND SUMMARY OF THE INVENTION

The invention relates to a hydraulic adjusting device for adjusting the initiation of injection by a fuel injection internal combustion engine of the type having a reciprocating pump shaft driven by a pump shaft roller tappet engaging a rotating crankshaft or the like. Preferred arrangements of the invention relate to such an adjusting device for self igniting internal combustion engines.

In German unexamined published application (DE-OS) No. 29 32 672 a hydraulic adjusting device for high pressure injection systems is disclosed which comprises means for changing the timing of the beginning of injection of fuel into the combustion chamber of the internal combustion engine. With this known arrangement the adjusting characteristics are reached by twisting or rotating the injection pump lifter shaft with respect to the motor crankshaft.

German published examined application DAS No. 1,107,025 relates to an injection pump adjusting arrangement of the kind the present invention is also directed at improving.

The invention is based upon the problem to establish a hydraulic adjusting device which is simple and requires a small construction space, which should not use any coupling connection between the motor crankshaft and the pump lifting shaft, and which rather operates directly on the pump shaft of the injection pump and is of the kind with adjustment characteristics influenced in a desirable manner by varying engine operational data.

This problem is inventively solved by a hydraulic adjusting device of the above mentioned type, in that specific means are provided through which the effective working stroke of the pump shaft is changed.

By adjustment of the effective working stroke of the pump shaft, a precise adjustment of the initiation of injection is obtained which is in contrast to the known adjusting devices arranged outside of the injection pump with resultant longer transfer paths and system irregularities.

A preferred embodiment of the invention provides that the adjusting device is formed at a work chamber bounded by a roller tappet support and with a guided inner piston of the pump shaft, which device shortens the working stroke of the pumping shaft and simultaneously moves the beginning of injection toward an earlier point in time in response to increasing control pressure in the work chamber.

In order to have adjustment of the injection initiation timing with low control pressure in the work chamber on the one hand, in spite of high pretension strength of the spiral or helically formed tappet biasing spring—and on the other hand to achieve a small adjustment movement of the inner piston with respect to the roller tappet support, it is further proposed that a cup spring (Bellville washer) is arranged in the work chamber to act against the tappet spring in such a manner that the cup spring lays substantially completely flat against both the roller tappet support and the inner piston during no or small control pressure effects in the work chamber.

With the arrangement of the cup spring the oil pressure respectively, the control pressure, can be reduced to zero. The spring strength of the tappet biasing spring therefor corresponds at least to the cup spring strength.

The slighest control pressure increase results in movement of the cup spring.

It is further provided according to especially preferred embodiments of the invention that the work chamber for the control pressure oil is connected by means of a control bore leading to a pressure line connected to collective pumping elements of the injection pump during the lower dead center position of the respective associated roller tappet. The pressure connection line extends in the longitudinal outer wall of the housing of the injection pump.

These and further objects, features and advantages of the present invention will become more obvious from the following description when taken in connection with the accompanying drawing which shows, for purposes of illustration only, a single embodiment in accordance with the present invention.

DETAILED DESCRIPTION OF THE DRAWINGS

Figure 1:
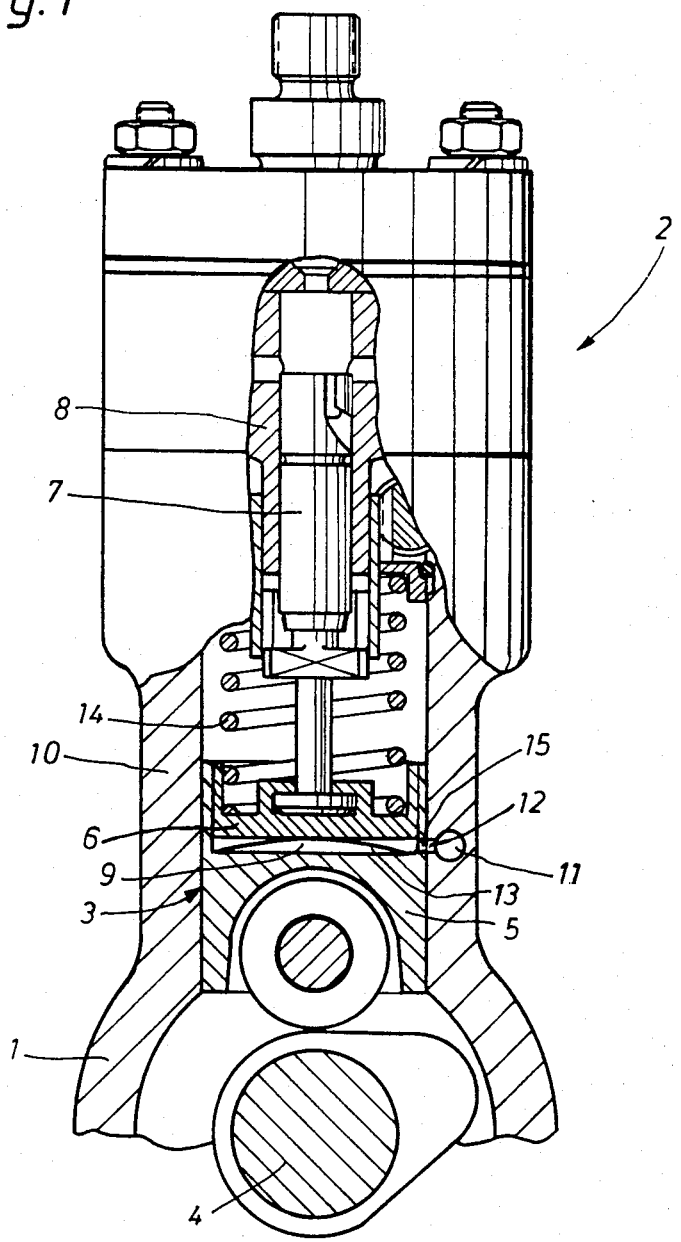
FIG. 1 is a schematic, part sectional side view of an injection pump unit constructed with an integrated adjusting device according to a preferred embodiment of the invention.
Figure 2:
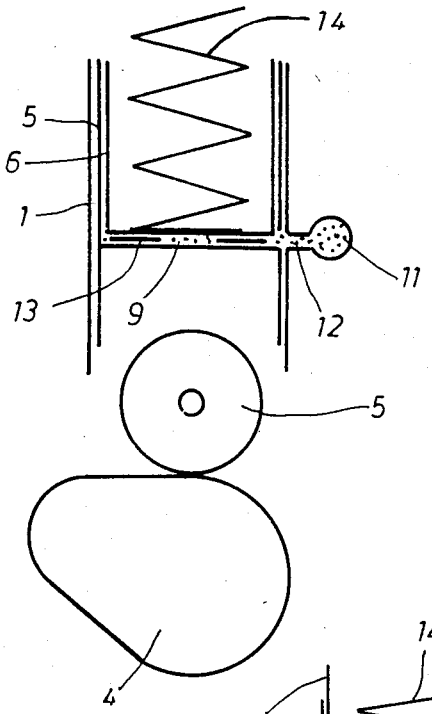
FIG. 2 schematically depicts the disposition of the adjustment device of FIG. 1 in an over flow phase with an inner piston which is not moved by the cup spring and working chamber pressure (large working stroke)
Figure 3:
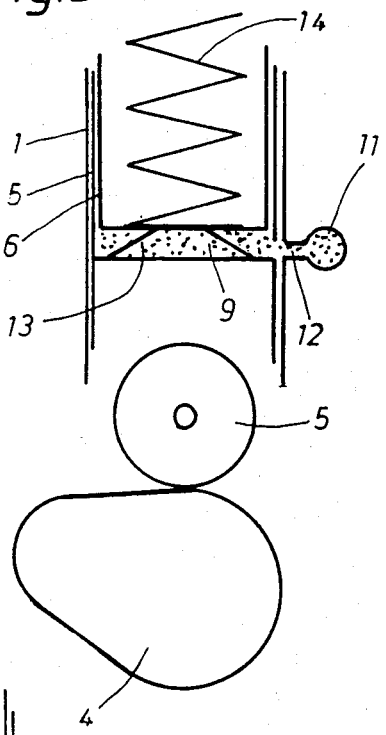
FIG. 3 schematically depicts the disposition of the adjusting device of FIG. 1 in an over flow phase with a large relative movement of the inner piston and the tappet support (small working stroke)
Figure 4:
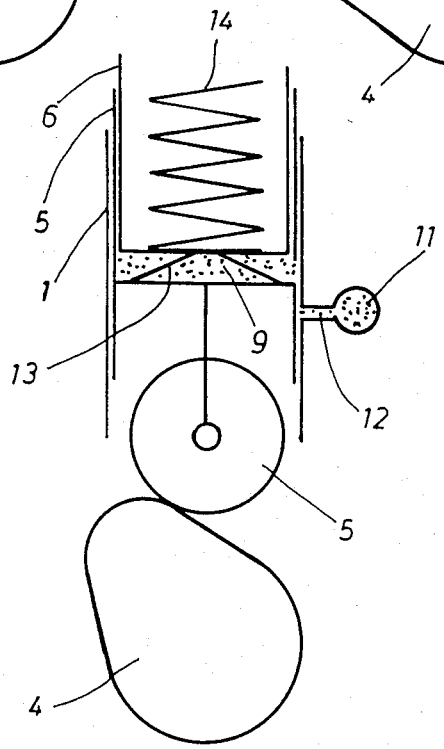
FIG. 4 schematically depicts the disposition of the adjusting device in the feeding phase with a large relative movement of the inner piston (small working stroke).

A pump driving shaft 4 is supported in housing 1 of an injection pump 2 with an integrated adjusting device 3 for the adjustment of the beginning of injection. Shaft 4 has a crank throw which engages a roller tappet carried at slidable tappet support 5. Tappet support 5 transmits motion to the pump plunger in cylinder 8 by way of an adjusting member in the form of inner piston 6. The inner piston 6 and the roller tappet support 5 form a work chamber 9 for the control oil pressure, which is supplied by way of control bore 12 and pressure line 11 arranged in the longitudinal outer wall 10 of the injection pump housing 1. Between the inner piston 6 and the roller tappet support 5 there is at least one cup spring 13, which is pressed flat by the long helical tappet spring 14 with a pressureless or low pressure work chamber 9.

At the bottom dead center position of the roller tappet support 5, the work chamber 9 is connected with the control pressure line 11 by means of cross bore 15 in the roller tappet support 5 and the control bore 12.

The control pressure is influenced by an electronic control device responsive to running motor characteristics. Details of the electronic control device are not included herein in order not to obscure the present invention. There are many available such control devices which are responsive to various engine operating parameters to vary the pressure of the hydraulic fluid or oil in line 11.

The relative movement of the inner piston 6 with respect to the roller tappet support 5 results from the cooperation of the tappet biasing spring 14, the cup spring 13 and the control fluid pressure.

With the arrangement of the cup spring 13, predetermined work or injection initiation points can be obtained with small movements. Furthermore, only the smallest control pressure in the control pressure line 11 is required (for example up to 2 atmospheres) to already have the largest relative movement of the inner piston 6 and therewith the smallest pump working stroke for the adjustment of the timing of the injection point. With increasing pressure and smaller working stroke, the beginning of feeding simultaneously relocates itself toward an earlier time.

With the upward movement of the roller tappet support 5, starting from the lower dead center position, the cross bore 15 is effectively moved away from the region of the cross bore 12, and the actual effective injection at the established working stroke commences.

In order to limit the movement of the inner piston 6, a mechanical stop in the form of a safety ring can be provided on the roller tappet support 5.

With the arrangement of this invention, a sharp or large fuel injection rate or amount can be implemented at low rotational speeds (late initiation of feeding=larger working stroke), and furthermore an improvement in the engine exhaust condition and power is obtained.

While I have shown and described the embodiment in accordance with the present invention, it is understood that the same is not limited thereto but is susceptible to numerous changes and modifications as would be known to those skilled in the art of the present disclosure and I therefore do not wish to be limited to the details shown and described therein but intend to cover all such changes and modifications as are encompassed by the scope of the appended claims.

I claim:

1. Hydraulic adjusting device for controlling the initiation of injection by a fuel injection pump for an internal combustion engine of the type having a reciprocating pump shaft driven by a pump shaft roller tappet engaging a rotating crankshaft, or the like comprising:

a working chamber communicating with hydraulic control fluid which is pressurized in dependance on engine operating parameters, said working chamber being bounded by a tappet support for said tappet and a spring biased slidable inner piston member which is movable with the pump shaft, and a cup washer disposed in the working chamber intermediate the tappet support and the inner piston member, said cup washer being configured to change the effective length of the pump injection stroke in dependence on the control pressure in the working chamber.

2. Device according to claim 1, wherein the working chamber is communicated with a control bore leading to the hydraulic control fluid line when the tappet support is in its lower dead center position.

3. Device according to claim 2, wherein said cup washer abuttingly engages the tappet support and the inner piston member at respective opposite facing sides thereof and is in substantially flattened condition when the working chamber fluid pressure is below a certain predetermined level.

4. Device according to claim 3, wherein said control fluid line is a common line of a series of injection pumping elements of the engine which extends in the longitudinal outer wall of the injection pump housing.

5. Device according to claim 1, wherein said cup washer is pushed by said spring biased piston member to a compressed condition when the working chamber fluid pressure is below a certain predetermined level.

6. Device according to claim 2, wherein said cup washer is pushed by said spring biased piston member to a compressed condition when the working chamber fluid pressure is below a certain predetermined level.

7. Device according to claim 6, wherein said control fluid line is a common line of a series of injection pumping elements of the engine which extends in the longitudinal outer wall of the injection pump housing.

8. Device according to claim 5, wherein said cup washer is pushed by said spring biased piston member to a completely compressed flattened condition when the working chamber fluid pressure is below a certain predetermined level.

9. Device according to claim 6, wherein said cup washer is pushed by said spring biased piston member to a completely compressed flattened condition when the working chamber fluid pressure is below a certain predetermined level.

10. Device according to claim 3, wherein said cup washer is in a completely flattened condition when the working chamber fluid pressure is below a certain predetermined level.

* * * * *